US005707308A

United States Patent [19]

Liu

[11] Patent Number: 5,707,308

[45] Date of Patent: Jan. 13, 1998

[54] PUCK

[76] Inventor: Tai-ping Liu, No. 15, Alley 8, Lane 3, Kuochi St., Lungching Hsiang, Taichung Hsien, Taiwan

[21] Appl. No.: 665,746

[22] Filed: Jun. 18, 1996

[51] Int. Cl.[6] ..... A63B 71/00

[52] U.S. Cl. ..... 473/588

[58] Field of Search ..... 273/126 R, 128 R, 273/128 CS; 473/588

[56] References Cited

U.S. PATENT DOCUMENTS

| | | | |
|---|---|---|---|
| 2,467,043 | 4/1949 | Kotler | 273/128 R |
| 2,727,744 | 12/1955 | Watson | 273/128 R |
| 4,153,253 | 5/1979 | White | 273/128 R |
| 5,269,520 | 12/1993 | Velliness | 273/128 R |
| 5,275,410 | 1/1994 | Bellehumeur | 273/128 R |
| 5,482,274 | 1/1996 | Bellehumeur | 273/128 R |

*Primary Examiner*—Theatrice Brown
*Attorney, Agent, or Firm*—Schmeiser, Olsen & Watts

[57] ABSTRACT

A puck includes a top side, a bottom side and a peripheral surface, the top side having a plurality of first vent holes defined therein, the bottom side having a plurality of second vent holes defined therein and the peripheral surface having a plurality of third vent holes defined therein, a first passage defined through the puck and communicating with each pair of the closest first vent hole and third vent hole, a second passage defined through the puck and communicating with each pair of the closest second vent hole and the third vent hole such that when the puck slides on a surface, the first passages and the second passages guide air to flow therethrough so as to let the puck slide smoothly and in a straight direction.

6 Claims, 8 Drawing Sheets

PUCK

BACKGROUND OF THE INVENTION

1. Field of the Invention

The present invention relates to a puck and more particularly, to an improved puck having a plurality of first vent holes and second vent holes defined inclinedly about an axis of the puck, through the puck, so as to guide air flows to flow through the first and the second vent holes such that the puck moves smoothly.

2. Brief Description of the Prior Art

FIG. 1 shows a conventional puck which is made as a disk 90 with flat surfaces defined respectively in a top side and a bottom side of the disk 90. However, the puck has an inherent shortcoming which is that when the puck is hit to slide on a surface, it cannot maintain a straight direction and will veer aside because of a resistance of the air. Furthermore, when used on ice surface, the puck could be adhered by the melted ice by the atmosphere pressure.

FIG. 3 shows another type of a conventional puck which is a ring element 80 with three bosses 84 extending from an upper surface and a bottom thereof, an inner ring 81 is disposed in a center of the ring element 80 by three arms 85 extending from an inner periphery of the ring element 80 to connect between the inner ring 81 and the ring element 80 such that there is a less friction between the puck and a surface on which the puck slides. However, such a puck still encounters undesirable air resistance, as shown in FIG. 2, when it moving and this is not satisfactory for hockey players.

The present invention intends to provide an improved puck which has vent holes defined through the puck so as to mitigate and/or obviate the above-mentioned problems.

SUMMARY OF THE INVENTION

The present invention provides a puck which is a disk element and includes a top side, a bottom side and a peripheral surface. The top side has a plurality of first vent holes defined therein, the bottom side has a plurality of second vent holes defined therein and the peripheral surface has a plurality of third vent holes defined therein. A first passage is defined through the puck and communicates with each pair of the closest first vent holes and third vent holes, a second passage defined through the puck and communicating with each pair of the closest second vent holes and the third vent holes.

Accordingly, when the puck slides on a surface, the first passages and the second passages guide air to flow therethrough so as to let the puck slide smoothly and in a straight direction.

It is an object of the present invention to provide a puck capable of sliding stably and smoothly.

It is another object of the present invention to provide a puck having passages defined from the peripheral surface respectively through the top side and the bottom side thereof.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
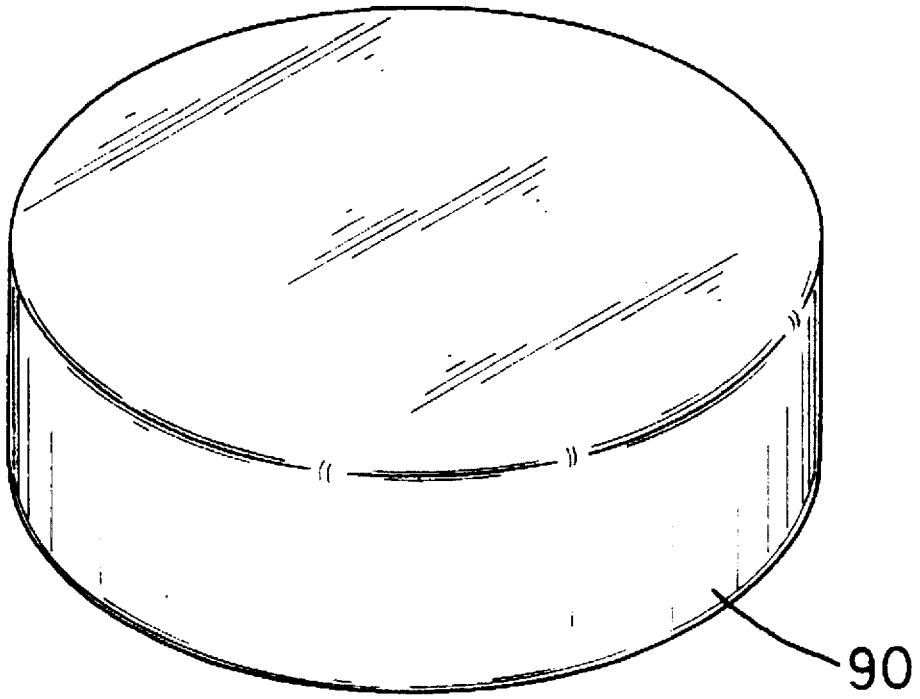
FIG. 1 PRIOR ART
FIG. 1 is a perspective view of a first type of prior art puck.
Figure 2:
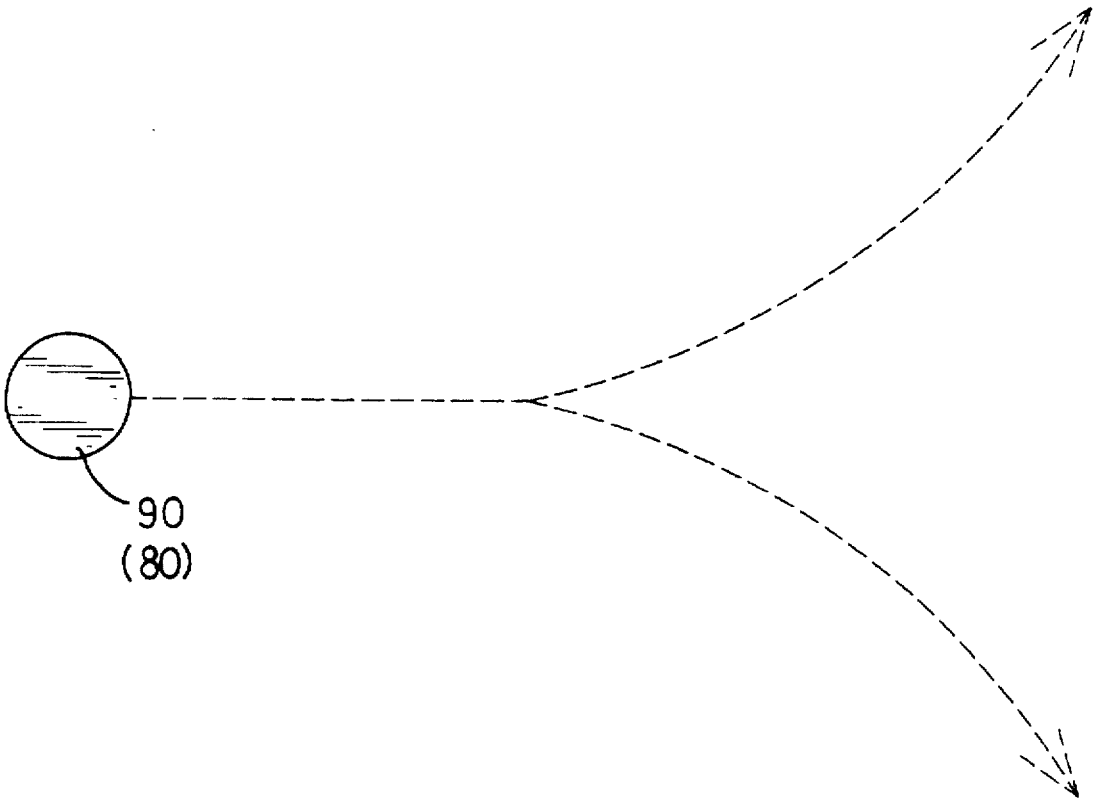
FIG. 2 PRIOR ART
FIG. 2 is an illustrative view to show the puck as shown in FIGS. 1 and 3 cannot slide in a straight direction.
Figure 3:
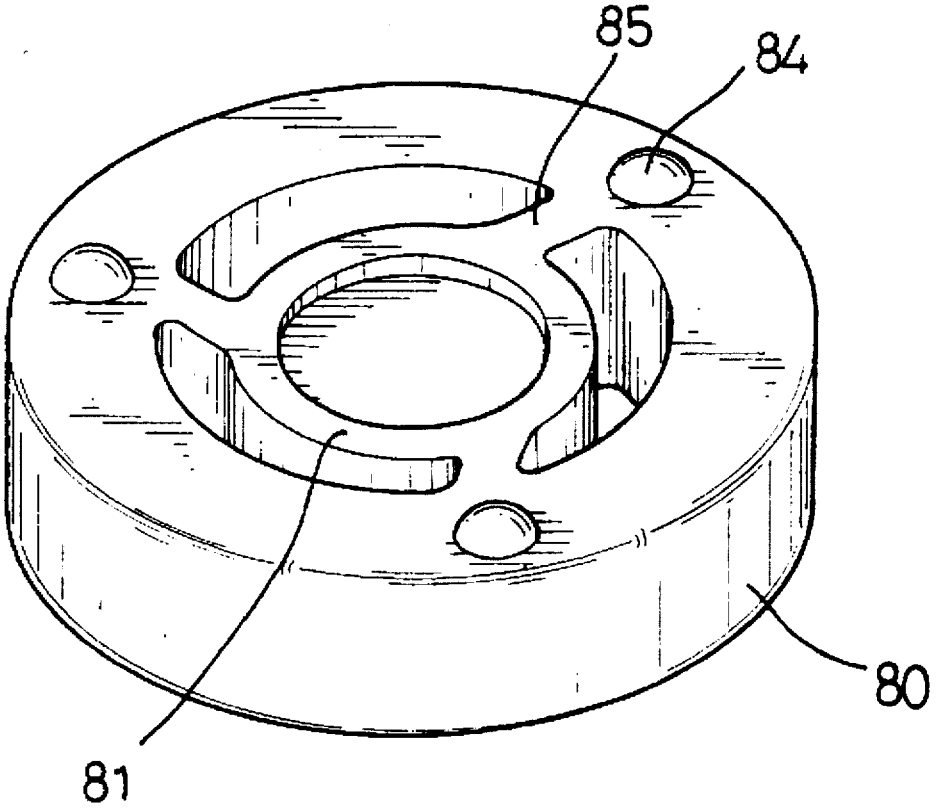
FIG.3 PRIOR ART
FIG. 3 is a perspective view of a second type of prior art puck.
Figure 4:
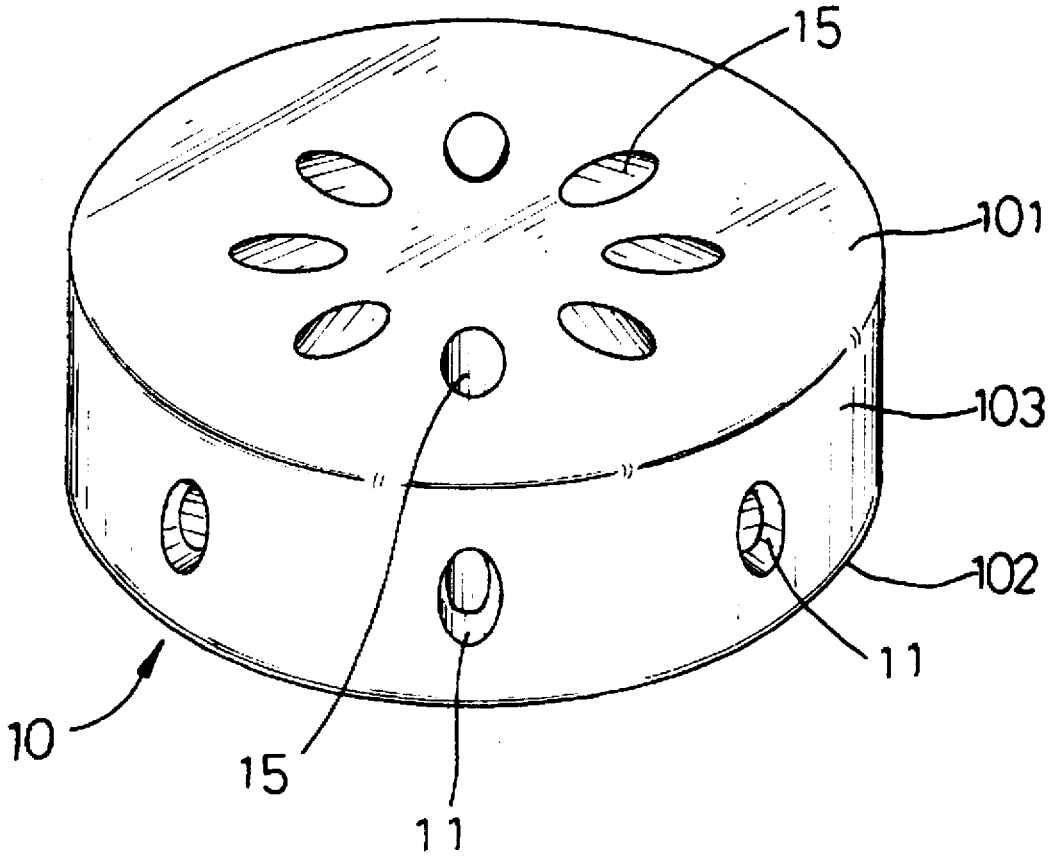
FIG. 4 is a perspective view of a puck in accordance with the present invention.
Figure 5:
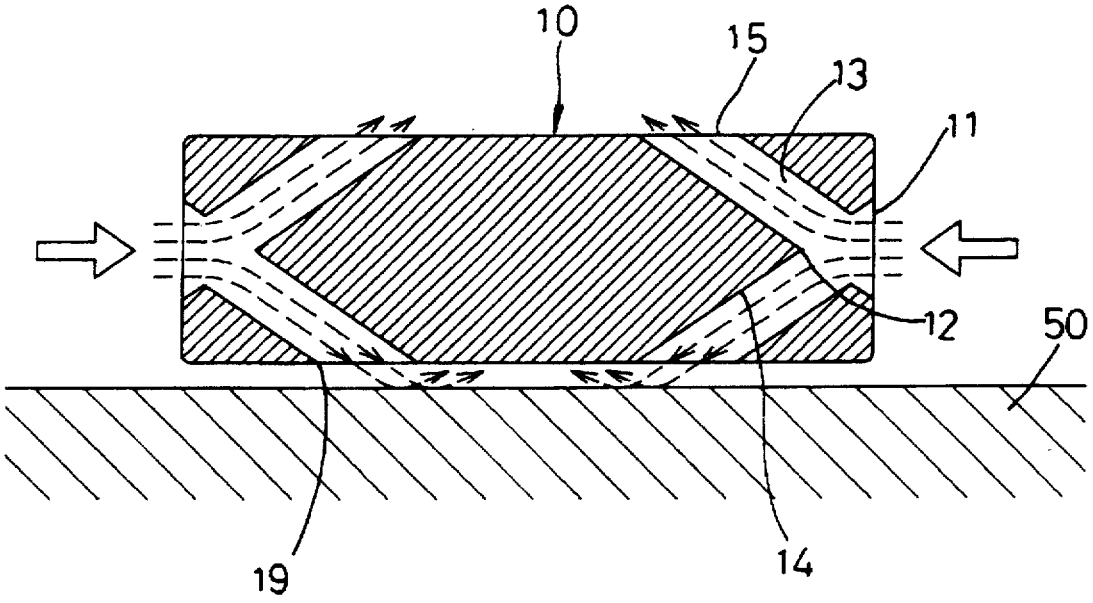
FIG. 5 is a side elevational view, partly in section, of the puck wherein air flows are shown by arrows.
Figure 6:
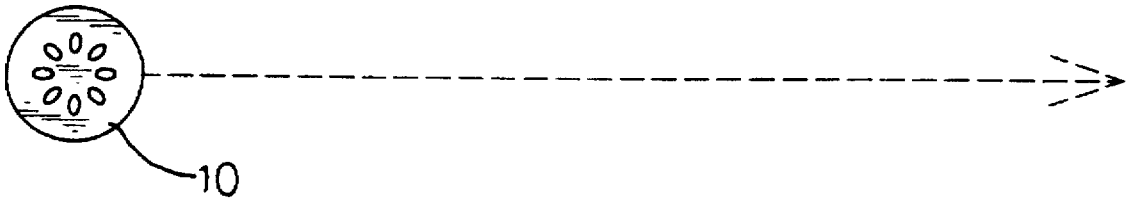
FIG. 6 is an illustrative view to show the puck of the invention can slide in a straight direction.

Referring to the drawings and initially to FIGS. 4 through 6, a puck 10 in accordance with the present invention generally is a disk element which includes a top side 101, a bottom side 102 and a peripheral surface 103. The top side 101 has eight first vent holes 15 defined therein, the bottom side 102 has eight second vent holes 19 (see FIG. 5) defined therein and the peripheral surface 103 has eight third vent holes 11 defined therein. The first vent holes 15, the second vent holes 19 and the third vent holes 11 are respectively aligned so that a respective plurality of Y-shaped passage communicate therebetween. That is, each third vent hole 11 communicates with a respective first vent hole 15 and a respective second vent hole 19 via a respective Y-shaped passage. The Y-shaped passage comprises a first passage 13 which communicates with the closest pair of first vent hole 15 and the third vent hole 11, and a second passage 14 which communicates with the closest pair of the second vent hole 19 and the third vent hole 11. A cone portion 12 formed between the first passage 13 and the second passage 14.

Accordingly, when the puck 10 slides on a surface 50, air enters from the third vent holes 11 and flows out from the first vent holes 15 and the second vent holes 19 via the Y-shaped passage so as to reduce resistance of the air. Furthermore, the air flowing out from the second vent holes 19 will create pressure between the bottom side 102 of the puck 10 and the surface upon which it is sliding so as to slightly lift the puck upwardly such that a friction between the bottom side 102 and the surface 50 can be reduced.

Figure 7:
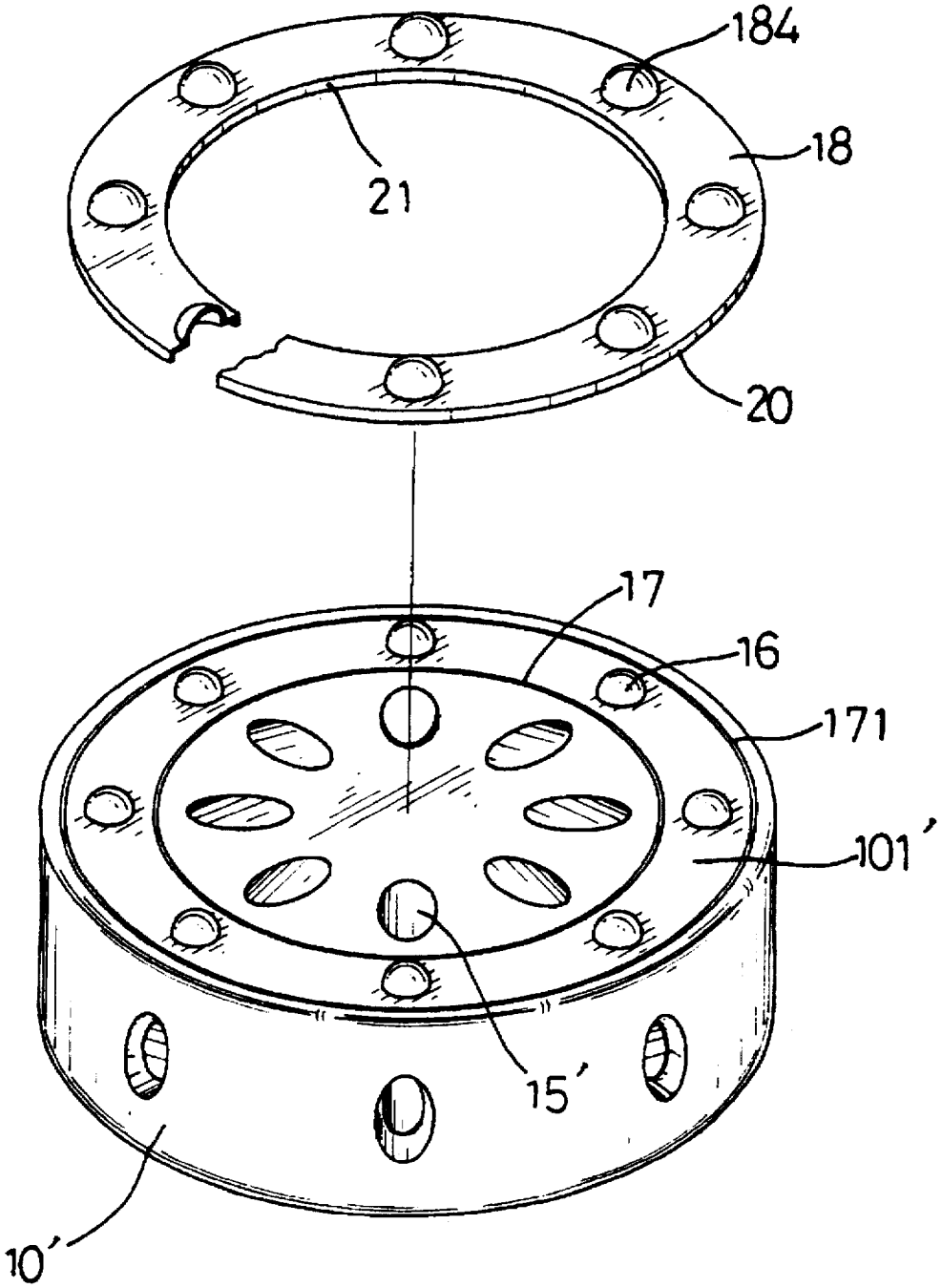
FIG. 7 is an exploded view of another embodiment of the puck in accordance with the present invention.
Figure 8:
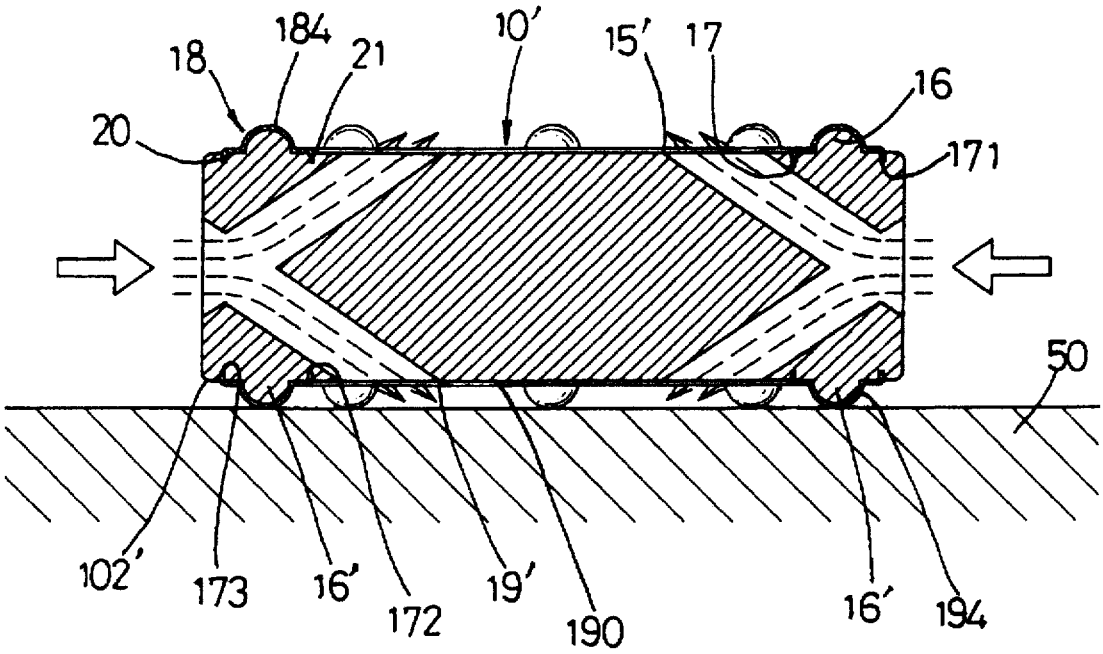
FIG. 8 is a side elevational view, partly in section, of the puck shown in FIG. 7 wherein air flows are shown by arrows.

Referring to FIGS. 7 and 8 which show another embodiment of the puck wherein the puck has a first ring 18 disposed to the top side 101' thereof and a second ring 190 disposed to the bottom side 102' thereof. Each of the top side 101' and the bottom side 102' of the puck 10' has a first annular groove 17, 172 and a second annular groove 171, 173 defined therein wherein the first annular groove 17/172 has a diameter smaller than that of the second annular groove 171/173, whereby all the first vent holes 15' and the second vent holes 19' are located within the first annular groove 17, 172. Each of the first ring 18 and the second ring 190 has an outer peripheral flange 20 and an inner peripheral flange 21 extending downwardly therefrom such that the inner peripheral flange 21 is inserted into the first annular groove 17/172 and the outer peripheral flange 20 is inserted into the second annular groove 171/173. Each of the first ring 18 and the second ring 190 has eight protrusions 184, 194 extending therefrom. Each of the top side 101' and the bottom side 102' of the puck 10' has eight bosses 16, 16' extending therefrom so as to be mounted by the corresponding protrusion 184, 194.

Accordingly, the puck 10' can slide on the surface 50 with less friction between the eight protrusions 194 and the surface 50.

Although the invention has been explained in relation to its preferred embodiment, it is to be understood that many other possible modifications and variations can be made without departing from the spirit and scope of the invention as hereinafter claimed.

What is claimed is:

1. A puck having a top side, a bottom side and a peripheral surface, at least one first vent hole defined in said top side, at least one second vent hole defined in said bottom side and at least one third vent hole defined in said peripheral surface, a first passage defined through said puck and communicating with said first vent hole and said third vent hole, a second passage defined through said puck and communicating with said second vent hole and said third vent hole, said first passage and said second passage being separated in said puck by a cone formed between said first passage and said second passage.

2. The puck as claimed in claim 1 wherein said top side and said bottom side of said puck each have at least three bosses extending therefrom.

3. The puck as claimed in claim 1 wherein said puck has a first ring disposed to said top side thereof and a second ring disposed to said bottom side thereof, each of said first ring and said second ring having at least three protrusions extending therefrom.

4. The puck as claimed in claim 3 wherein each of said top side and said bottom side of said puck has a first annular groove and a second annular groove defined therein wherein said first annular groove has a diameter smaller than that of said second annular groove, each of said rings having an outer peripheral flange and an inner peripheral flange such that said inner peripheral flange is inserted into said first annular groove and said outer peripheral flange is inserted into said second annular groove.

5. A puck having a top side, a bottom side and a peripheral surface, at least one first vent hole defined in said bottom side and at least one second vent hole defined in said peripheral surface, a first passage defined through said puck and communicating with said first vent hole and said second vent hole, said top side and said bottom side of said puck each having at least three bosses extending therefrom, a first ring disposed to said top side and a second ring disposed to said bottom side of said puck, each of said first ring and said second ring having at least three protrusions extending therefrom.

6. The puck as claimed in claim 5 wherein each of said top side and said bottom side of said puck has a first annular groove and a second annular groove defined therein wherein said first annular groove has a diameter smaller than that of said second annular groove, each of said rings having an outer peripheral flange and an inner peripheral flange such that said inner peripheral flange is inserted into said first annular groove and said outer peripheral flange is inserted into said second annular groove.

* * * * *